US006676421B1

(12) United States Patent
Bynes

(10) Patent No.: US 6,676,421 B1
(45) Date of Patent: Jan. 13, 2004

(54) ELECTRICAL PLUG LOCKING ASSEMBLY

(76) Inventor: Sammie L. Bynes, 2123 Eastland Dr., Augusta, GA (US) 30904

( * ) Notice: Subject to any disclaimer, the term of this patent is extended or adjusted under 35 U.S.C. 154(b) by 0 days.

(21) Appl. No.: 10/302,610

(22) Filed: Nov. 22, 2002

(51) Int. Cl.[7] ..... H01R 13/44
(52) U.S. Cl. ..... 439/134
(58) Field of Search ..... 439/134, 133, 439/135; 24/30.5 P, 30.5 R; 70/57, 169

(56) References Cited

U.S. PATENT DOCUMENTS 4,679,873 A 7/1987 Brackett, Jr.
5,338,212 A 8/1994 Kerrigan
5,507,656 A 4/1996 Ales
5,591,038 A 1/1997 Guzay, Jr. et al.
D386,149 S 11/1997 Malone, Sr. et al.
5,848,905 A 12/1998 Patel
5,890,919 A * 4/1999 Geisler ..... 439/134

* cited by examiner

*Primary Examiner*—Gary Paumen

(57) ABSTRACT

An electrical plug locking assembly for preventing plugging a male electrical plug into an electrical outlet includes a block member of a first material and having a plurality of openings for receiving prongs of a male electrical plug. Arm portions of a second material are coupled to the block member. Further, a locking member is securable through the pair of arm portions extending from the block member. When secured to the arm portions, the lock member holds the arm portions in a position adjacent to a rear portion of a head of the male electrical plug when the prongs of the plug are inserted into the block member. Thus, the arms are held in a position preventing removal of the prongs from the block member.

4 Claims, 4 Drawing Sheets

ELECTRICAL PLUG LOCKING ASSEMBLY

BACKGROUND OF THE INVENTION

1. Field of the Invention

The present invention relates to electrical plug locks and more particularly pertains to a new electrical plug locking assembly for preventing plugging a male electrical plug into an electrical outlet.

2. Description of the Prior Art

The use of electrical plug locks is known in the prior art. U.S. Pat. No. 5,338,212 describes a single material device having a center block for receiving the prongs of a male electrical plug and straps that are padlocked around the cord of the male electrical plug to prevent removal of the prongs from the center block. Another type of electrical plug lock is U.S. Pat. No. 5,848,905 having a U-shaped piece that is coupled to the prongs of a male electrical plug and locked into a locking member to physically obstruct insertion of the prongs into an electrical outlet. U.S. Pat. No. 5,591,038 discloses a U-shaped member for securing prongs of a male electrical plug to a shield member that prevents insertion of the prongs into an electrical outlet. U.S. Pat. No. 4,679,873 discloses a housing to enclose a male electrical plug. U.S. Pat. No. 5,507,656 a housing having a spring loaded interior mechanism for engaging the prongs of a male electrical plug. U.S. Pat. No. Des. 386,149 shows an ornamental design for a housing that encloses a male electrical plug.

While these devices fulfill their respective, particular objectives and requirements, the need remains for a device that has a simple design, prevents removal of the device from a male electrical plug, and does not damage the electrical plug and cord.

SUMMARY OF THE INVENTION

The present invention meets the needs presented above by providing a block member of a first material and having a plurality of openings for receiving prongs of a male electrical plug. Arm portions of a second material are coupled to the block member. Further, a locking member is securable through the pair of arm portions extending from the block member. When secured to the arm portions, the lock member holds the arm portions in a position adjacent to a rear portion of a head of the male electrical plug when the prongs of the plug are inserted into the block member. Thus, the arms are held in a position preventing removal of the prongs from the block member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
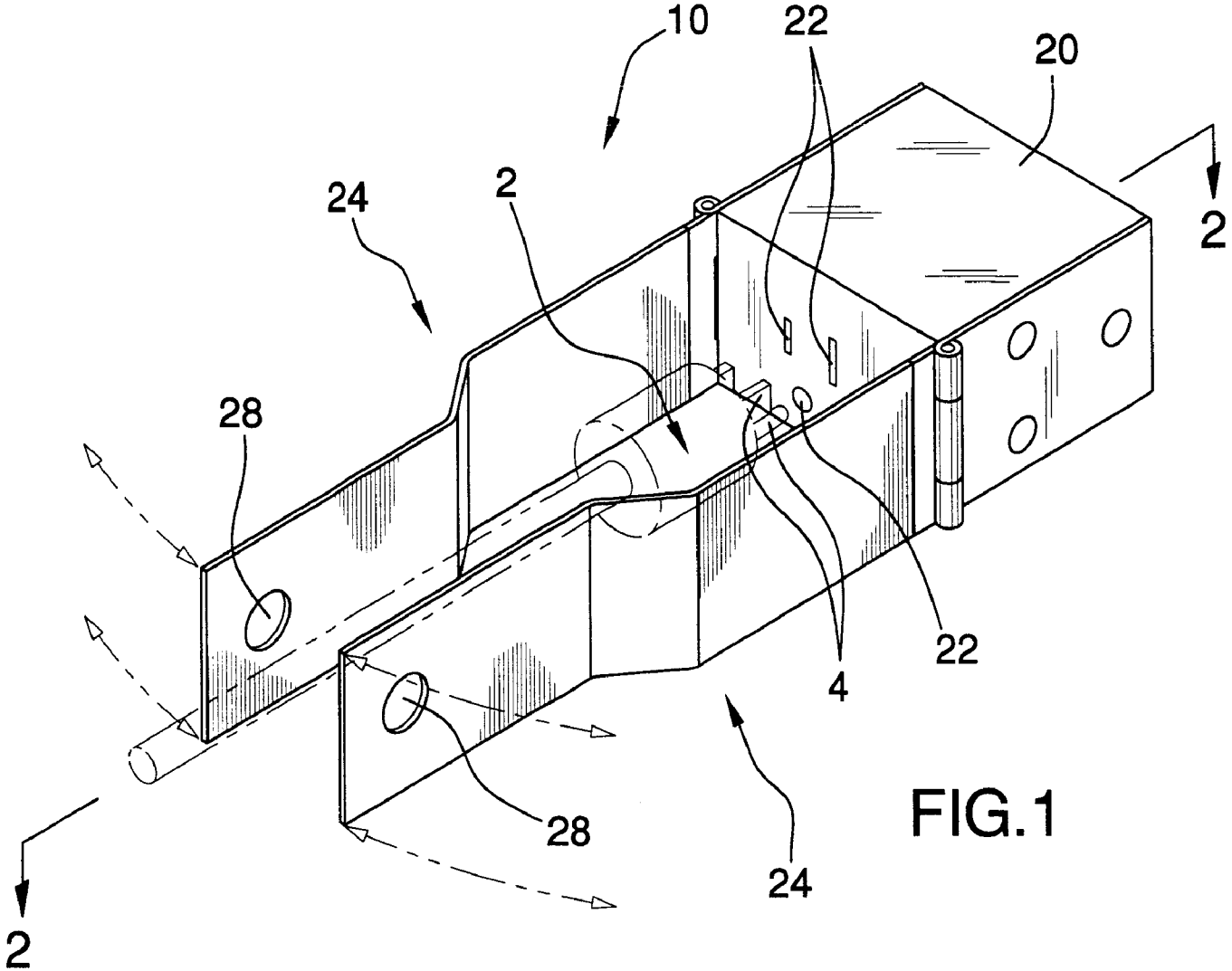
FIG. 1 is a perspective view of a new electrical plug locking assembly according to the present invention.
Figure 2:
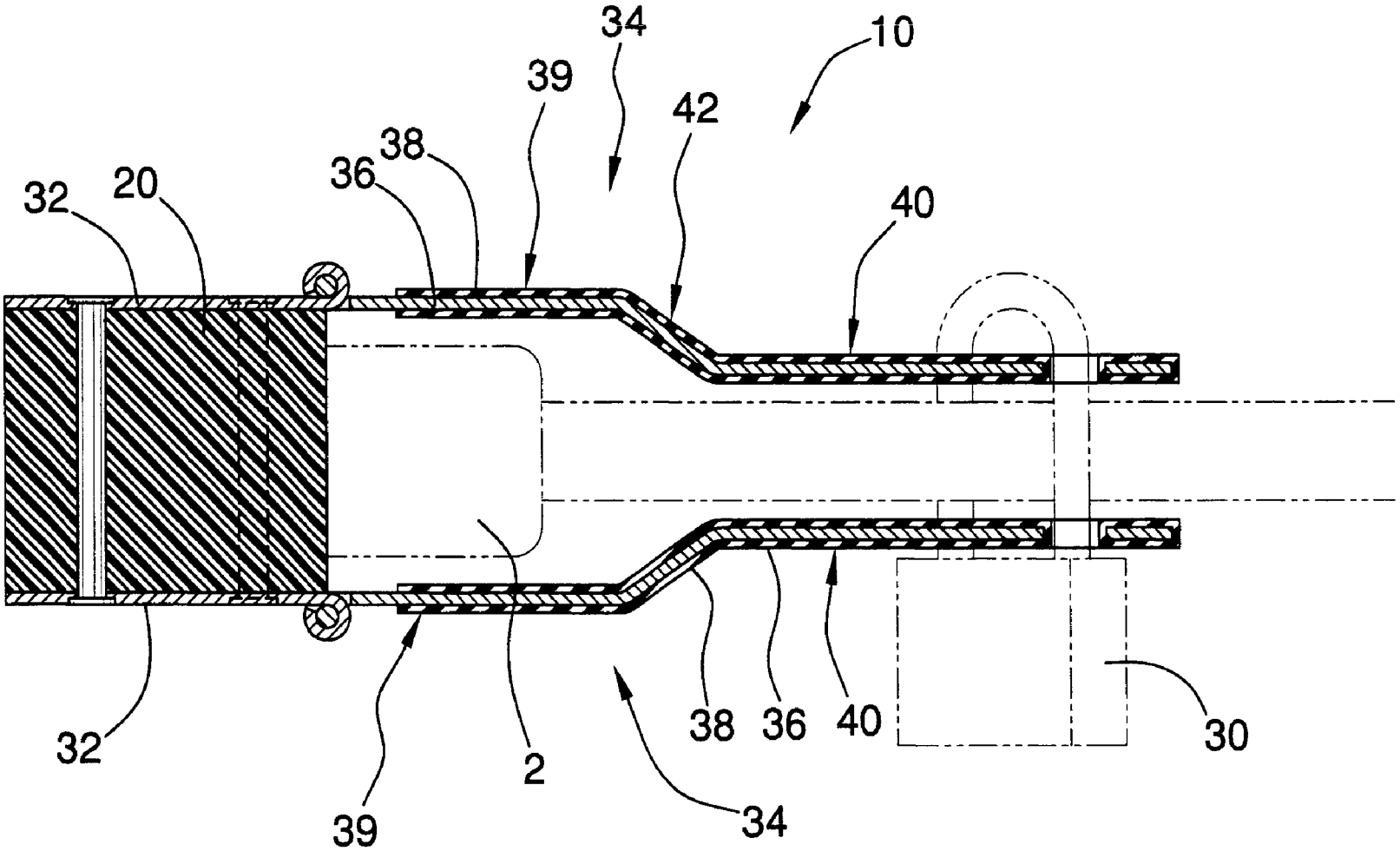
FIG. 2 is a cross-sectional view of the present invention taken along line 2—2 in FIG. 1.
Figure 3:
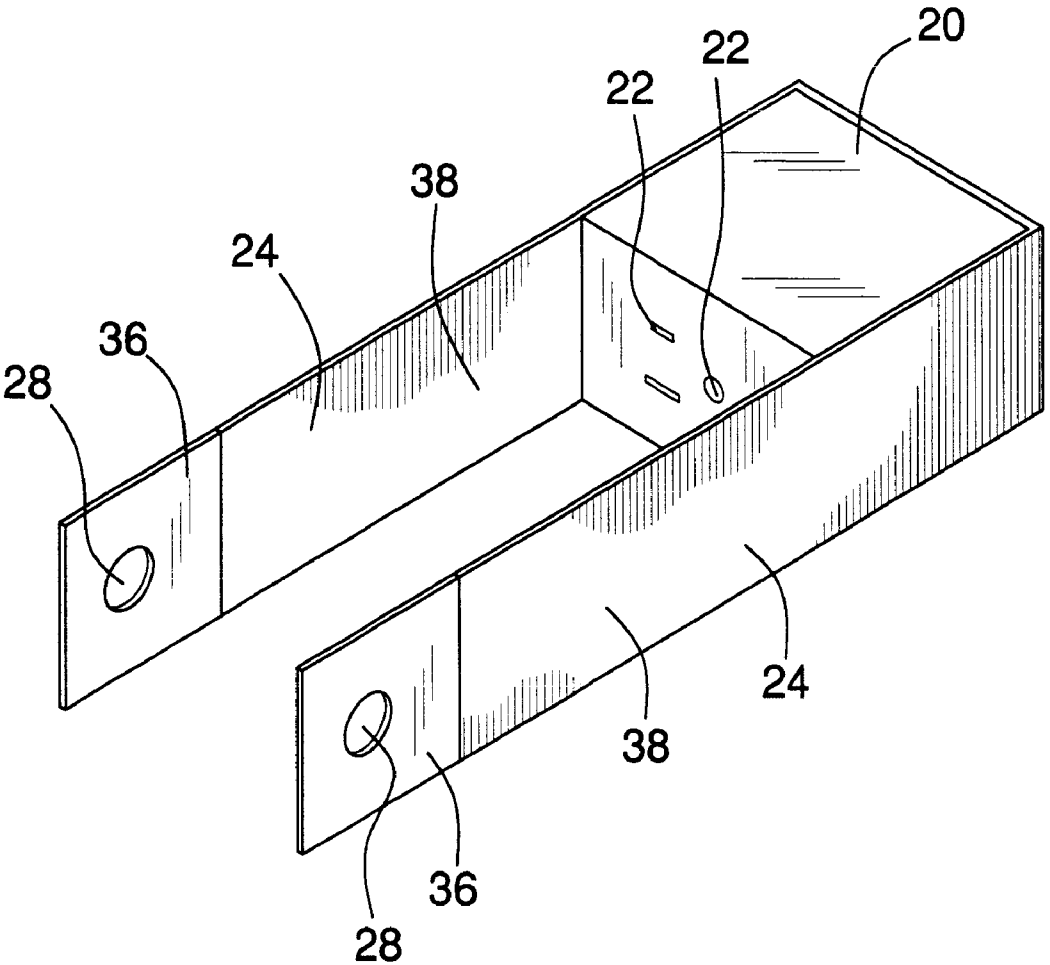
FIG. 3 is a perspective view of an embodiment of the present invention.
Figure 4:
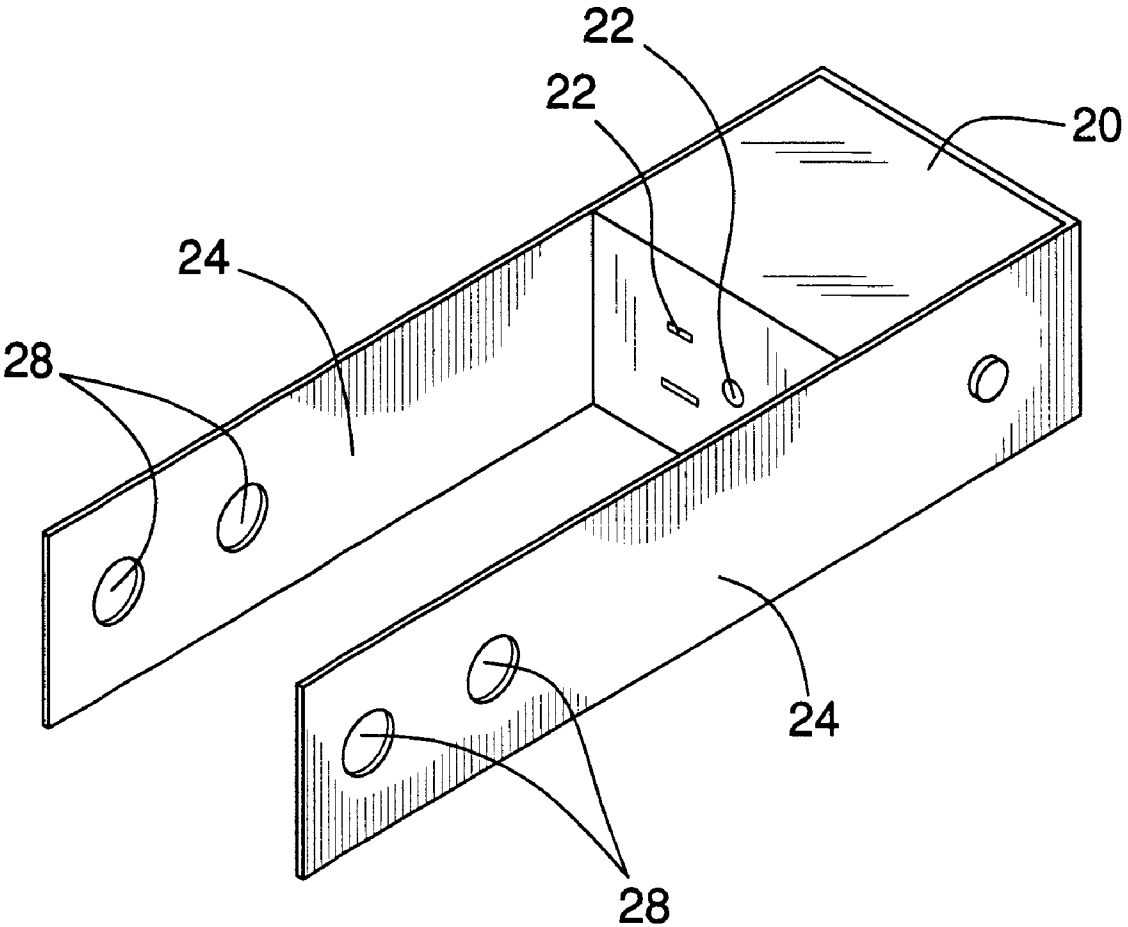
FIG. 4 is a perspective view of an embodiment of the present invention.

With reference now to the drawings, and in particular to FIGS. 1 through 4 thereof, a new electrical plug locking assembly embodying the principles and concepts of the present invention and generally designated by the reference numeral 10 will be described.

As best illustrated in FIGS. 1 through 4, the electrical plug locking assembly 10 generally comprises a block member 20 having a plurality of openings 22. The openings 22 are configured for receiving prongs 4 of a male electrical plug 2.

A pair of arm portions 24 are coupled to the block member 20. The arm portions 24 extend from the block member 20 and each has a respective aperture 28.

A lock member 30 is securable through the apertures 28 in the arm portions 24 such that the arm portions 24 are held in a position adjacent to the block member 20 to prevent removal of the male electrical plug 2 from the block member 20.

Each of the arm portions 24 includes a planar connection portion 32 attached to the block member 20. Each arm portion 24 also includes an outer portion 34 hingedly attached to the planar connection portion 32. Each of the arm portions 24 has a core portion 36 and a protective cover portion 38. Typically, the cover portion 38 is constructed of rubber to protect the cord extending from the male plug 2 and to provide insulation of the arm portions 24 when they are made of a conductive material. Each of the arm portions 24 has a proximal portion 39, a distal portion 40, and an offset portion 42 extending between the proximal portion 39 and the distal portion 40 such that the distal portions 40 of the arm portions 24 are positioned closer to each other than the proximal portions 39 when both of the arm portions 24 extend outwardly from the block member 20 in a first direction.

In an embodiment, the block member 20 is constructed of a resilient non-conductive material such as rubber or plastic. Each of the arm portions 24 is rigid metal. At least one metal pin is inserted through the arm portions and the block member to secure the arm portions to the block member.

Various embodiments may also include integral extensions forming the arm portions, straight arm portions, multiple apertures on each arm portion, and the arm portions being joined together by a portion of rigid material that extends around and substantially covers a rear face of the block member.

In use, the prongs of the male plug are inserted into the block member. The arm portions are pivoted towards each other and the lock member is inserted through the arm portions to secure them together. The arm portions obstruct removal of the male plug from the block member until the lock member is removed and the arm portions are moved away from each other out of the way of the plug.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical plug locking assembly comprising:

a block member having a plurality of openings, said openings being configured for receiving prongs of a male electrical plug;

a pair of arm portions coupled to said block member, said arm portions extending from said block member, said arm portions each having a respective aperture;

a lock member securable through said apertures in said arm portions such that said arm portions are held in a position adjacent to said block member to prevent removal of the male electrical plug from said block member;

wherein each of said arm portions has a proximal portion, a distal portion, and an offset portion extending between said proximal portion and said distal portion such that said distal portions of said arm portions are positioned closer to each other than said proximal portions when both said arm portions extend outwardly from said block member in a first direction;

wherein said block member is constructed of a resilient non-conductive material; and each said arm portion is constructed of a rigid metal.

2. The electrical plug locking assembly of claim 1 wherein each of said arm portions includes a planar connection portion attached to said block member.

3. The electrical plug locking assembly of claim 2 wherein each arm portion includes an outer portion hingedly attached to said planar connection portion.

4. The electrical plug locking assembly of claim 1 wherein each of said arm portions has a core portion and a protective cover portion.

* * * * *